US010253605B2

(12) United States Patent
Robb et al.

(10) Patent No.: US 10,253,605 B2
(45) Date of Patent: Apr. 9, 2019

(54) CONSTRUCTED ANNULAR SAFETY VALVE ELEMENT PACKAGE

(75) Inventors: Ewan Ogilvie Robb, Brechin (GB); Jeremy Buc Slay, Fort Worth, TX (US); Winston James Webber, Arbroath (GB)

(73) Assignee: Halliburton Energy Services, Inc., Houston, TX (US)

( * ) Notice: Subject to any disclaimer, the term of this patent is extended or adjusted under 35 U.S.C. 154(b) by 519 days.

(21) Appl. No.: 14/422,582

(22) PCT Filed: Aug. 27, 2012

(86) PCT No.: PCT/US2012/052533

§ 371 (c)(1),
(2), (4) Date: Feb. 19, 2015

(87) PCT Pub. No.: WO2014/035369

PCT Pub. Date: Mar. 6, 2014

(65) Prior Publication Data

US 2015/0226047 A1 Aug. 13, 2015

(51) Int. Cl.
*E21B 43/12* (2006.01)
*E21B 33/12* (2006.01)
(Continued)

(52) U.S. Cl.
CPC ..... *E21B 43/123* (2013.01); *E21B 33/1208* (2013.01); *E21B 33/128* (2013.01);
(Continued)

(58) Field of Classification Search
CPC ..... E21B 33/12; E21B 33/1216; E21B 34/10; E21B 34/08; E21B 33/1285; E21B 43/10; E21B 33/1208
See application file for complete search history.

(56) References Cited

U.S. PATENT DOCUMENTS 4,274,489 A * 6/1981 Harris ..... E21B 33/1291 166/139
4,421,323 A 12/1983 Burke
(Continued)

FOREIGN PATENT DOCUMENTS

EP 1649136 B1 10/2008
GB 2433262 A 6/2007
(Continued)

OTHER PUBLICATIONS

Burkert Chemical Resistance guide. Accessed on Oct. 21, 2016 via http://www.forberg.com/pdf/techSup/Home_Tech%20Support_Burket%20Chemical%20Resistance%20Guide.pdf.*
(Continued)

*Primary Examiner* — David J Bagnell
*Assistant Examiner* — Manuel C Portocarrero
(74) *Attorney, Agent, or Firm* — Scott Richardson; Baker Botts L.L.P.

(57) ABSTRACT

An annular safety valve sealing package that is suitable for use in the presence of an acid gas and that is capable of retaining its material properties when the annular safety valve is retrieved is provided. The annular safety valve sealing package includes an annular safety valve having a tubular housing, a first annular sealing element including a first elastomeric material and disposed about the tubular housing, a second annular sealing element including a second elastomeric material and disposed about the tubular housing, and a third annular sealing element including a third elastomeric material and disposed about the tubular housing on an opposite side of the second annular sealing element from the first annular sealing element. At least two of the first elastomeric material, the second elastomeric material, or the third elastomeric material have different compositions.

8 Claims, 7 Drawing Sheets

(51) Int. Cl.

| | |
|---|---|
| ***E21B 33/128*** | (2006.01) |
| ***E21B 34/08*** | (2006.01) |
| ***E21B 43/16*** | (2006.01) |
| ***E21B 34/10*** | (2006.01) |

(52) U.S. Cl.
CPC ..... *E21B 33/1285* (2013.01); *E21B 34/08* (2013.01); *E21B 34/10* (2013.01); *E21B 34/105* (2013.01); *E21B 43/168* (2013.01)

(56) References Cited

U.S. PATENT DOCUMENTS

| | | | | |
|---|---|---|---|---|
| 4,433,847 | A | 2/1984 | Weinberg | |
| 4,597,446 | A * | 7/1986 | Helderle | E21B 23/02 166/217 |
| 4,720,113 | A | 1/1988 | Hertz, Jr. | |
| 5,474,127 | A | 12/1995 | White | |
| 5,617,918 | A | 4/1997 | Cooksey et al. | |
| 5,810,083 | A | 9/1998 | Kilgore | |
| 6,325,144 | B1 | 12/2001 | Turley et al. | |
| 6,378,609 | B1 | 4/2002 | Oneal et al. | |
| 6,431,291 | B1 | 8/2002 | Moore et al. | |
| 6,464,003 | B2 | 10/2002 | Bloom et al. | |
| 6,640,894 | B2 | 11/2003 | Bloom et al. | |
| 6,715,559 | B2 | 4/2004 | Bloom et al. | |
| 6,821,147 | B1 | 11/2004 | Hall et al. | |
| 7,048,047 | B2 | 5/2006 | Bloom et al. | |
| 7,080,998 | B2 | 7/2006 | Hall et al. | |
| 7,191,829 | B2 | 3/2007 | Bloom et al. | |
| 7,275,593 | B2 | 10/2007 | Bloom et al. | |
| 7,392,859 | B2 | 7/2008 | Mock et al. | |
| 7,527,099 | B2 | 5/2009 | Bosma et al. | |
| 7,578,347 | B2 | 8/2009 | Bosma et al. | |
| 7,604,049 | B2 | 10/2009 | Vaidya et al. | |
| 7,604,060 | B2 | 10/2009 | Bloom et al. | |
| 7,607,497 | B2 | 10/2009 | Mock et al. | |
| 7,631,697 | B2 | 12/2009 | Bhaysar | |
| 7,954,563 | B2 | 6/2011 | Mock et al. | |
| 8,069,917 | B2 | 12/2011 | Bloom et al. | |
| 8,181,708 | B2 | 5/2012 | Korte et al. | |
| 2005/0161212 | A1 | 7/2005 | Leismer et al. | |
| 2006/0076145 | A1 | 4/2006 | Lembcke et al. | |
| 2006/0186601 | A1 | 8/2006 | Lopez | |
| 2007/0056725 | A1 | 3/2007 | Lucas et al. | |
| 2007/0056747 | A1 | 3/2007 | Jacob | |
| 2007/0284108 | A1* | 12/2007 | Roes | E21B 36/04 166/302 |
| 2009/0146381 | A1 | 6/2009 | Herrera | |
| 2009/0200023 | A1* | 8/2009 | Costello | E21B 43/24 166/260 |
| 2009/0211751 | A1 | 8/2009 | Ocalan et al. | |
| 2009/0255690 | A1 | 10/2009 | Conner et al. | |
| 2010/0132960 | A1 | 6/2010 | Shkurli et al. | |
| 2010/0181727 | A1 | 7/2010 | Santi et al. | |
| 2010/0326737 | A1 | 12/2010 | Peddle et al. | |
| 2011/0162836 | A1 | 7/2011 | Church | |
| 2011/0220359 | A1 | 9/2011 | Soliman et al. | |

FOREIGN PATENT DOCUMENTS

| | | | |
|---|---|---|---|
| GB | 2443724 | A | 5/2008 |
| GB | 2362405 | A | 11/2011 |
| WO | 2006053896 | A1 | 5/2006 |
| WO | 2007029214 | A2 | 3/2007 |
| WO | 2007031723 | A2 | 3/2007 |
| WO | 2007031723 | A3 | 5/2007 |
| WO | 2007029214 | A3 | 8/2007 |
| WO | 2010007439 | A2 | 1/2010 |
| WO | 2010007439 | A3 | 3/2010 |
| WO | 2010039131 | A1 | 4/2010 |
| WO | 2011097091 | A2 | 8/2011 |
| WO | 2011097091 | A3 | 10/2011 |

OTHER PUBLICATIONS

Search Report issued in related European Application No. 12883689.7, dated Jun. 10, 2016 (7 pages).

Halliburton brochure entitled "Annular Safety Systems," 2 pages, Halliburton Energy Services, Inc.

International Search Report and Written Opinion issued in related PCT Application No. PCT/US2012/052533 dated May 29, 2013, 15 pages.

Examination Report issued in related European Patent Application No. 12883689.7 dated Jul. 24, 2018, 4 pages.

* cited by examiner

CONSTRUCTED ANNULAR SAFETY VALVE ELEMENT PACKAGE

CROSS-REFERENCE TO RELATED APPLICATION

This application is a U.S. National Stage Application of International Application No. PCT/US2012/052533 filed Aug. 27, 2012, which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

The present invention relates generally to an apparatus used in subterranean wells and, in some embodiments thereof, provides a retrievable annular safety valve system with a sealing element. Annular safety valves are used in various completion and/or workover assemblies such as those used in gas lift operations in subterranean wells. In a gas lift operation, gas, such as hydrocarbon gas, is flowed from the earth's surface to gas valves positioned near a producing formation intersected by a well. The gas valves are typically installed in production tubing extending to the earth's surface and permit the gas to flow from an annulus, between the production casing and production tubing, to the interior of the tubing. Once inside the tubing, the gas rises, due to its buoyancy, and carries fluid from the formation to the earth's surface along with it.

Because the gas is pumped from the earth's surface to the gas valves through the annulus, it is highly desirable, from a safety standpoint, to install a valve in the annulus. The valve is commonly known as an annular safety valve. Its function is to control the flow of fluids axially through the annulus and minimize the volume of gas contained in the annulus between the valve and surface. In most cases, the annular safety valve is designed to close when a failure or emergency has been detected.

One type of safety valve is a control line operated annular safety valve. Fluid pressure in a small tube (e.g., a control line) connected to the annular safety valve maintains the valve in its open position (permitting fluid flow axially through the annulus) against a biasing force exerted by a spring. If the fluid pressure is lost, for example if the control line is cut, the valve is closed by the spring biasing force. Thus, the annular safety valve fails closed.

In gas lift operations, the annular safety valve is typically positioned near the earth's surface such that, if a blowout, fire, etc. occurs, the annular safety valve may be closed. In this manner, the gas flowed into the annulus below the safety valve will not be permitted to flow upward through the annular safety valve to the earth's surface where it may further feed a fire.

SUMMARY OF THE INVENTION

In an embodiment, an annular safety valve sealing package comprises an annular safety valve comprising a tubular housing; a first annular sealing element comprising a first elastomeric material and disposed about the tubular housing of the annular safety valve; a second annular sealing element comprising a second elastomeric material and disposed about the tubular housing of the annular safety valve adjacent the first annular sealing element; and a third annular sealing element comprising a third elastomeric material and disposed about the tubular housing of the annular safety valve adjacent the second annular sealing element and on an opposite side of the second annular sealing element from the first annular sealing element. At least two of the first elastomeric material, the second elastomeric material, or the third elastomeric material have different compositions. The annular safety valve may be configured to allow axial flow of a fluid through an annulus in a first configuration and substantially prevent axial flow of the fluid through the annular safety valve in a second configuration. The first elastomeric material, the second elastomeric material, or the third elastomeric material may comprise a material selected from the group consisting of: ethylene propylene diene monomer, fluoroelastomers, perfluoroelastomers, fluoropolymer elastomers, polytetrafluoroethylene, copolymer of tetrafluoroethylene and propylene, polyetheretherketone, polyetherketone, polyamide-imide, polyimide, polyphenylene sulfide, and any combination thereof. The first elastomeric material may have a greater chemical resistance than the second elastomeric material. The second elastomeric material may have a greater chemical resistance than the first elastomeric material. The first elastomeric material and the third elastomeric material may be the same. The third elastomeric material may have a greater chemical resistance than the second elastomeric material. The first elastomeric material, the second elastomeric material, and the third elastomeric material may each comprise different materials.

In an embodiment, an annular safety valve sealing package comprises an annular safety valve comprising a tubular housing; and a plurality of annular sealing elements disposed about the tubular housing, wherein one or more of the plurality of annular sealing elements comprise an annular inner core comprising a first elastomeric material and an outer element layer disposed on an outer surface of the annular inner core, wherein the outer element layer comprises a second elastomeric material. At least one of the first elastomeric material or the second elastomeric materials may comprise a material selected from the group consisting of: ethylene propylene diene monomer, fluoroelastomers, perfluoroelastomers, fluoropolymer elastomers, polytetrafluoroethylene, copolymer of tetrafluoroethylene and propylene, polyetheretherketone, polyetherketone, polyamide-imide, polyimide, polyphenylene sulfide, and any combination thereof. The first elastomeric material may have a greater chemical resistance than the second elastomeric material. The second elastomeric material may have a greater chemical resistance than the first elastomeric material. The first elastomeric material may comprise hydrogenated nitrile butadiene rubber or nitrile butadiene rubber. The one or more of the plurality of annular sealing elements may further comprise a third layer comprising a third elastomeric material disposed between the annular inner core and the outer element layer. Each of the plurality of annular sealing elements may comprise an annular inner core comprising the first elastomeric material and a corresponding outer element layer disposed on an outer surface of the corresponding annular inner core, and the outer element layer may comprise the second elastomeric material.

In an embodiment, a method of providing gas lift in a wellbore comprises producing a gas from a production tubing located in a wellbore, wherein the wellbore comprises a casing disposed therein; injecting a portion the gas into an annular space between the casing and the production tubing; and flowing the injected gas through an annular safety valve and into the production tubing. The annular safety valve comprises a tubular housing and a sealing package comprising a plurality of annular sealing elements disposed about the tubular housing, and at least two of the plurality of annular sealing elements comprises elastomeric materials having different compositions. One or more of the elastomeric materials may comprise a material selected from the group consisting of: ethylene propylene diene monomer, fluoroelastomers, perfluoroelastomers, fluoropolymer elastomers, polytetrafluoroethylene, copolymer of tetrafluoroethylene and propylene, polyetheretherketone, polyetherketone, polyamide-imide, polyimide, polyphenylene sulfide, and any combination thereof. The gas may comprise a sour gas, and the method may also comprise scrubbing the gas to remove a portion of contaminants prior to injection the portion of the gas. The method may also include removing the annular safety valve from the wellbore, where one or more of the plurality of annular sealing elements may be at least partially restored to their initial positions. The annular safety valve may be removed after exposure to sour gas while in the wellbore.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
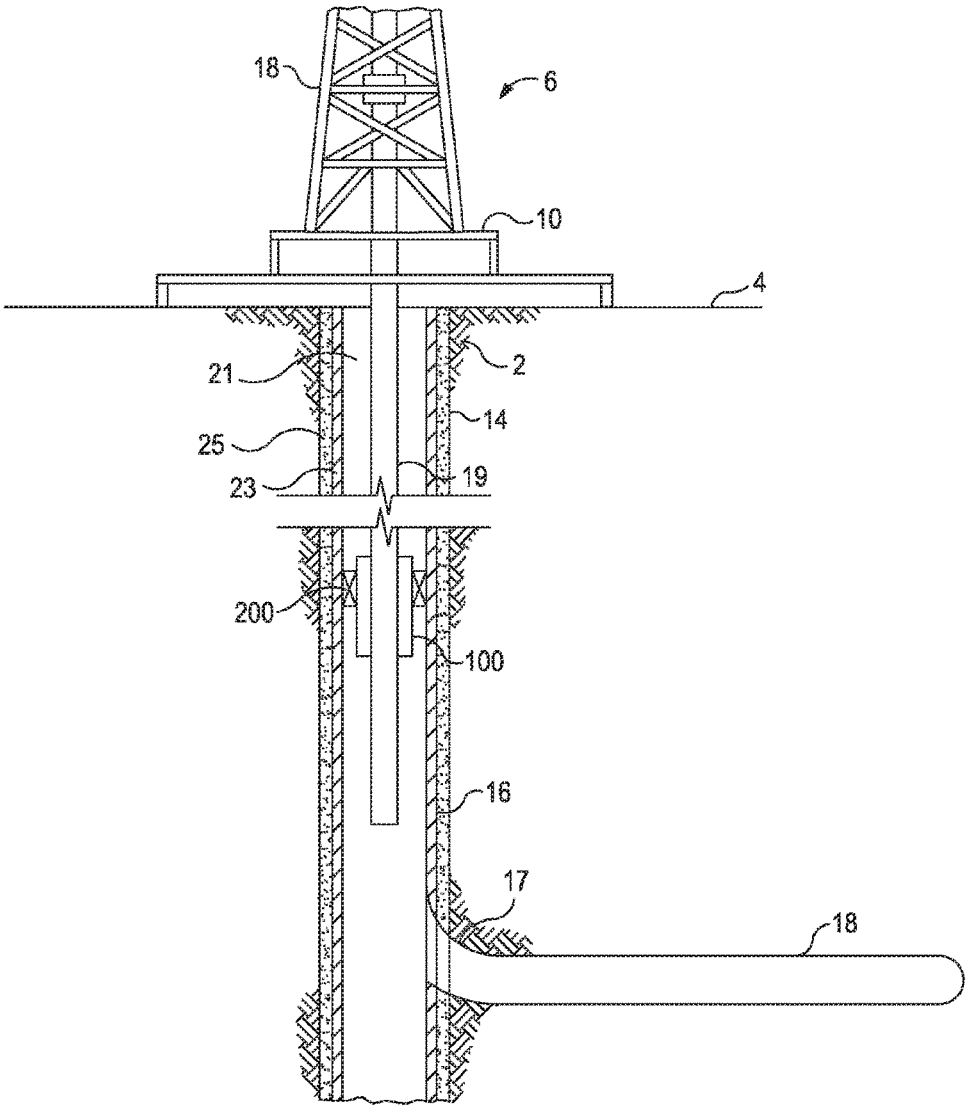
FIG. 1 illustrates a schematic cross section of an embodiment of a wellbore operating environment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. Reference to in or out will be made for purposes of description with "in," "inner," or "inward" meaning toward the center or central axis of the wellbore, and with "out," "outer," or "outward" meaning toward the wellbore tubular and/or wall of the wellbore. Reference to "longitudinal," "longitudinally," or "axially" means a direction substantially aligned with the main axis of the wellbore and/or wellbore tubular. Reference to "radial" or "radially" means a direction substantially aligned with a line between the main axis of the wellbore and/or wellbore tubular and the wellbore wall that is substantially normal to the main axis of the wellbore and/or wellbore tubular, though the radial direction does not have to pass through the central axis of the wellbore and/or wellbore tubular. The various characteristics mentioned above, as well as other features and characteristics described in more detail below, will be readily apparent to those skilled in the art with the aid of this disclosure upon reading the following detailed description of the embodiments, and by referring to the accompanying drawings.

Annular safety valves may typically be utilized in an annular space in a wellbore for an extended period of time. During use, corrosive and/or abrasive fluid may contact the safety valve's sealing surfaces, causing them to degrade (e.g., harden) over time. In some operating scenarios, the gas flowed from the earth's surface can be scrubbed to remove contaminants such as hydrogen sulfide ($H_2S$) and other acid gasses or chemicals (e.g., carbon dioxide, mercaptans, etc.) because the gas comes into contact with and can degrade the sealing element of the annular safety valve. However, it is not always feasible, due to space or cost constraints for example, to scrub the gas before injecting it into the well. Gas having such contaminants (e.g., $H_2S$) may be referred to as sour gas.

The annular safety valve's sealing elements may typically be made from nitrile butadiene rubber (NBR) or hydrogenated nitrile butadiene rubber (HNBR, or highly saturated nitrile, HSN). NBR, also referred to as Buna-N or Perbunan, is a copolymer of acrylonitrile and butadiene. HNBR may provide adequate service in some environments while maintaining material properties to allow retrieval of the annular safety valve. However, in applications where the gas is not scrubbed and contaminants are present, NBR may not be suitable and retrieval of the annular safety valve may be difficult. For example when NBR is exposed to $H_2S$ via contact with a sour gas, it hardens and becomes brittle. Though the integrity of the seal is maintained, the seal may not revert back to its unactuated or original state, making removal difficult. Different materials may be used that have a greater chemical resistance, for example Aflas® fluoro elastomer commercially available from Asahi Glass Ltd., or some other higher performance elastomeric compound. However, annular safety valve systems are normally run close to the surface of a well so temperatures at annular safety valve setting depths can be lower than 100° F., which can prevent sealing element materials such as Aflas® from performing in an adequate manner. These and other factors may contribute to improper functioning of the safety valve sealing element and upon removal of the safety valve. The systems and method described herein may provide a sealing element package suitable for use in the presence of an acid gas that is capable of retaining the material properties to be retrieved as a desired time.

Turning to FIG. 1, an example of a wellbore operating environment is shown. As depicted, the operating environment comprises a drilling rig 6 that is positioned on the earth's surface 4 and extends over and around a wellbore 14 that penetrates a subterranean formation 2 for the purpose of recovering hydrocarbons. The wellbore 14 may be drilled into the subterranean formation 2 using any suitable drilling technique. The wellbore 14 extends substantially vertically away from the earth's surface 4 over a vertical wellbore portion 16, deviates from vertical relative to the earth's surface 4 over a deviated wellbore portion 17, and transitions to a horizontal wellbore portion 18. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further the wellbore may be used for both producing wells and injection wells. In an embodiment, the wellbore may be used for purposes other than or in addition to hydrocarbon production, such as uses related to geothermal energy and/or the production of water (e.g., potable water).

A wellbore tubular string 19 comprising an annular safety valve 100 with the sealing element package 200 described herein may be lowered into the subterranean formation 2 for a variety of drilling, completion, workover, and/or treatment procedures throughout the life of the wellbore. The embodiment shown in FIG. 1 illustrates the wellbore tubular 19 in the form of a completion string being lowered into casing 23 held in place within wellbore 14 via cement 25, thereby forming an annulus 21 between wellbore tubular 19 and casing 23. It should be understood that the wellbore tubular 19 is equally applicable to any type of wellbore tubular being inserted into a wellbore, including as non-limiting examples drill pipe, production tubing, rod strings, and coiled tubing. In the embodiment shown in FIG. 1, the wellbore tubular 19 comprising the annular safety valve 100 may be conveyed into the subterranean formation 2 in a conventional manner.

The drilling rig 6 comprises a derrick 8 with a rig floor 10 through which the wellbore tubular 19 extends downward from the drilling rig 6 into the wellbore 14. The drilling rig 6 comprises a motor driven winch and other associated equipment for extending the wellbore tubular 19 into the wellbore 14 to position the wellbore tubular 19 at a selected depth. While the operating environment depicted in FIG. 1 refers to a stationary drilling rig 6 for lowering and setting the wellbore tubular 19 comprising the annular safety valve within a land-based wellbore 14, in alternative embodiments, mobile workover rigs, wellbore servicing units (such as coiled tubing units), and the like may be used to lower the wellbore tubular 19 into a wellbore. It should be understood that a wellbore tubular 19 may alternatively be used in other operational environments, such as within an offshore wellbore operational environment. In alternative operating environments, a vertical, deviated, or horizontal wellbore portion may be cased and cemented and/or portions of the wellbore may be uncased.

Regardless of the type of operational environment in which the annular safety valve 100 comprising the sealing element package 200 is used, it will be appreciated that the sealing element package 200 comprises a plurality of sealing elements, and at least two of the sealing elements may comprise different elastomeric materials. The different elastomeric materials may have different chemical resistances. In some embodiments, at least one of the plurality of sealing elements may comprise a layered configuration in which an outer layer in contact with the fluid in the wellbore may comprise a different material than the inner core. The outer layer may comprise a material having a different, for example greater, chemical resistance to one or more components encountered in the wellbore than the material forming the inner core. The inner core may then provide the mechanical properties to restore the sealing element if the annular safety valve is removed from the wellbore.

Turning to FIGS. 2A-2E, an embodiment of an annular safety valve 100 is illustrated. It is to be understood that the safety valve 100 is a continuous assembly, although it is representatively illustrated in separate figures herein for clarity of description. The safety valve 100 includes a generally tubular top sub 12. The top sub 12 is used to attach the safety valve 100 to an upper tubing string (e.g., wellbore tubular 19) for conveying the safety valve 100 into a subterranean well. For this purpose, the top sub 12 is preferably provided with suitable internal or external tapered threads of the type well known to those of ordinary skill in the art. For example, the top sub 12 may have EUE 8RD threads formed thereon. Alternatively, other means of connecting the top sub 12 may be used.

The generally tubular piston housing 20 is threadedly secured to the top sub 12. The piston housing 20 includes, in a sidewall portion thereof, a flow passage 22 which extends internally from an upper end 24 of the piston housing 20 to the interior of the piston housing axially between two axially spaced apart circumferential seals 26, 28. A conventional tube fitting 30 connects a relatively small diameter control line 32 to the piston housing 20, so that the control line 32 is in fluid communication with the flow passage 22. The tube fitting 30 is threadedly and sealingly attached to the piston housing 20. When operatively installed in a well, the control line 32 extends to the earth's surface and is conventionally secured to the upper tubing string with, for example, straps at suitable intervals. Fluid pressure may be applied to the control line 32 at the earth's surface with a pump. When sufficient fluid pressure has been applied to the control line 32, a generally tubular piston 34 axially slidingly disposed within the piston housing 20 is forced to displace axially downward. Fluid pressure in the flow passage 22 causes downward displacement of the piston 34 because the upper seal 26 sealingly engages an outer diameter 36 formed on the piston that is relatively smaller than an outer diameter 38 sealingly engaged by the lower seal 28. Thus, a differential piston area is formed between the diameters 36, 38. For this reason, seal 26 is also relatively smaller than seal 28.

Figure 2A:
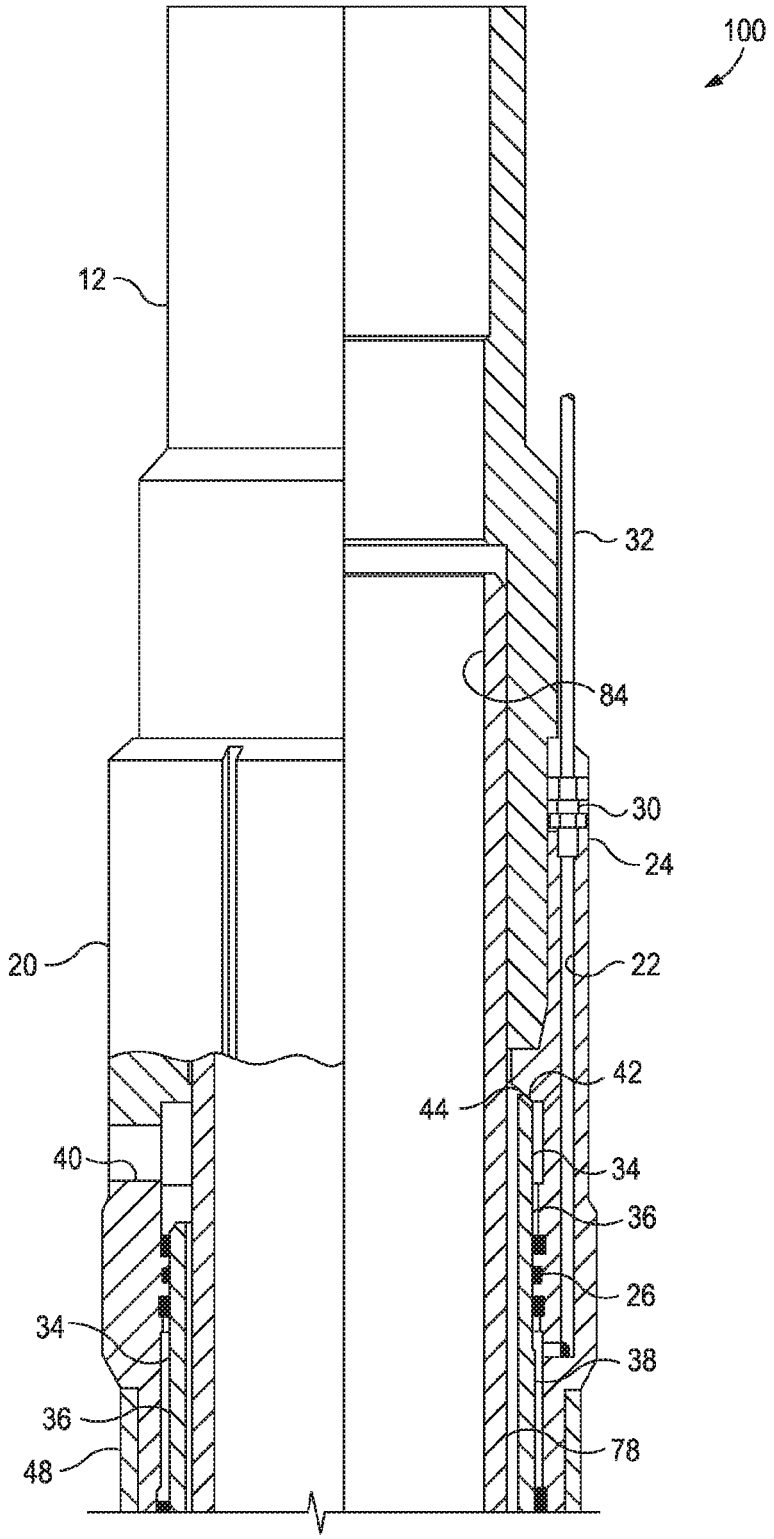
FIGS. 2A-2E are partially cross-sectional and partially elevational views of successive axial portions of an annular safety valve according to an embodiment.
Figure 2B:
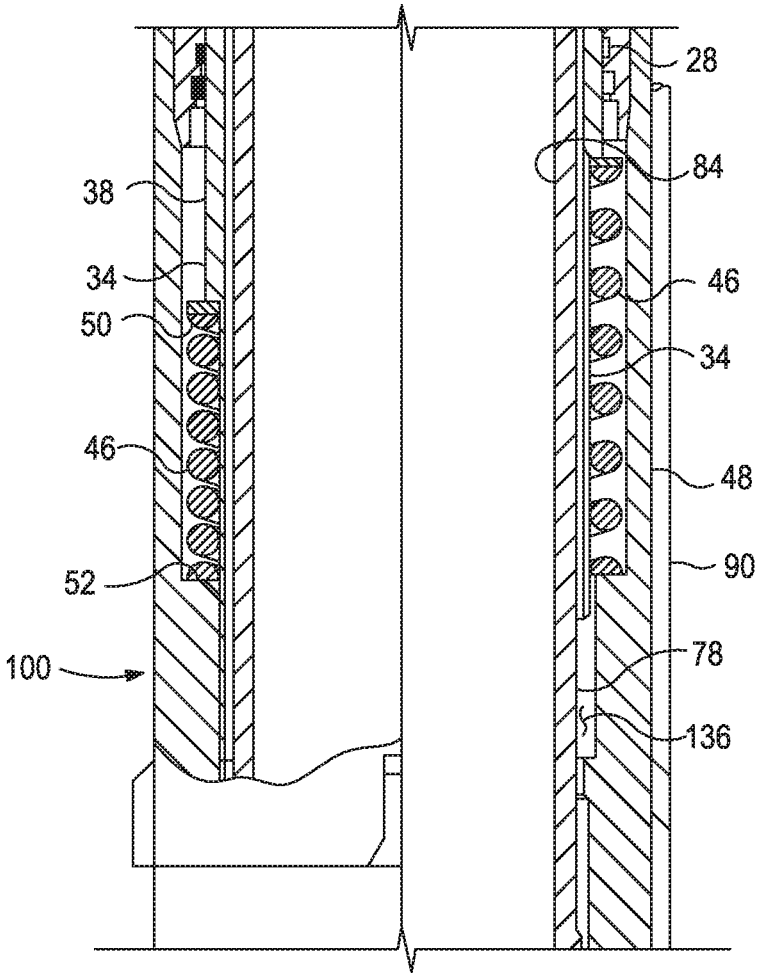

FIG. 2B shows the piston 34 axially downwardly displaced on the left, and axially upwardly displaced on the right of centerline. When the piston 34 is axially downwardly displaced via fluid pressure in the control line 32, fluid flow (e.g., lift gas) is permitted between the exterior of the safety valve 100 (e.g., annulus 21) and the interior of the safety valve through a set of radially extending and circumferentially spaced apart ports 40 formed through the piston housing 20. Thus, when the safety valve 100 is disposed within the wellbore, fluid communication is provided by the ports 40 from the annulus 21 formed radially between the wellbore and the safety valve to the interior of the safety valve.

When the piston 34 is axially upwardly, displaced, as shown on the right in FIG. 2B, an upper circumferential sealing surface 42 formed on the piston sealingly engages a complementarily shaped sealing surface 44 formed on the piston housing 20. Such sealing engagement between the sealing surfaces 42, 44 prevents fluid communication between the exterior and interior of the safety valve 100 through the ports 40. Note that each of the sealing surfaces 42, 44 are representatively illustrated as being formed of metal, but it is to be understood that other sealing surfaces, such as elastomeric, could be utilized without departing from the principles of the present invention.

Thus, when sufficient fluid pressure is applied to the control line 32 to downwardly displace the piston 34 relative to the piston housing 20, the safety valve 100 is in its "open" configuration, fluid flow being permitted between its interior and exterior through the ports 40. When, however, fluid pressure in the control line 32 is insufficient to downwardly displace or maintain the piston 34 downwardly displaced from the sealing surface 44, the safety valve 100 is in its "closed" position, sealing engagement between the sealing surfaces 42, 44 preventing fluid communication between its interior and exterior through the ports 40.

Still referring to FIG. 2B, the piston 34 is axially upwardly biased by a compression spring 46. Thus, to axially downwardly displace the piston 34 relative to the piston housing 20, fluid pressure applied to the control line 32 and acting on the differential piston area between the diameters 36, 38 must produce a force oppositely directed to, and greater than, that exerted by the spring 46. Note that biasing members other than the spring 46 may be utilized in the safety valve 100 without departing from the principles of the present invention, for example, the spring could be replaced by a chamber of compressible gas, such as nitrogen.

Referring to FIGS. 2A and 2B, the piston housing 20 is threadedly attached to a generally tubular and axially extending outer housing 48. The spring 46 is axially compressed between a shoulder 50 externally formed on the piston 34 and a shoulder 52 internally formed on the outer housing 48.

Figure 2C:
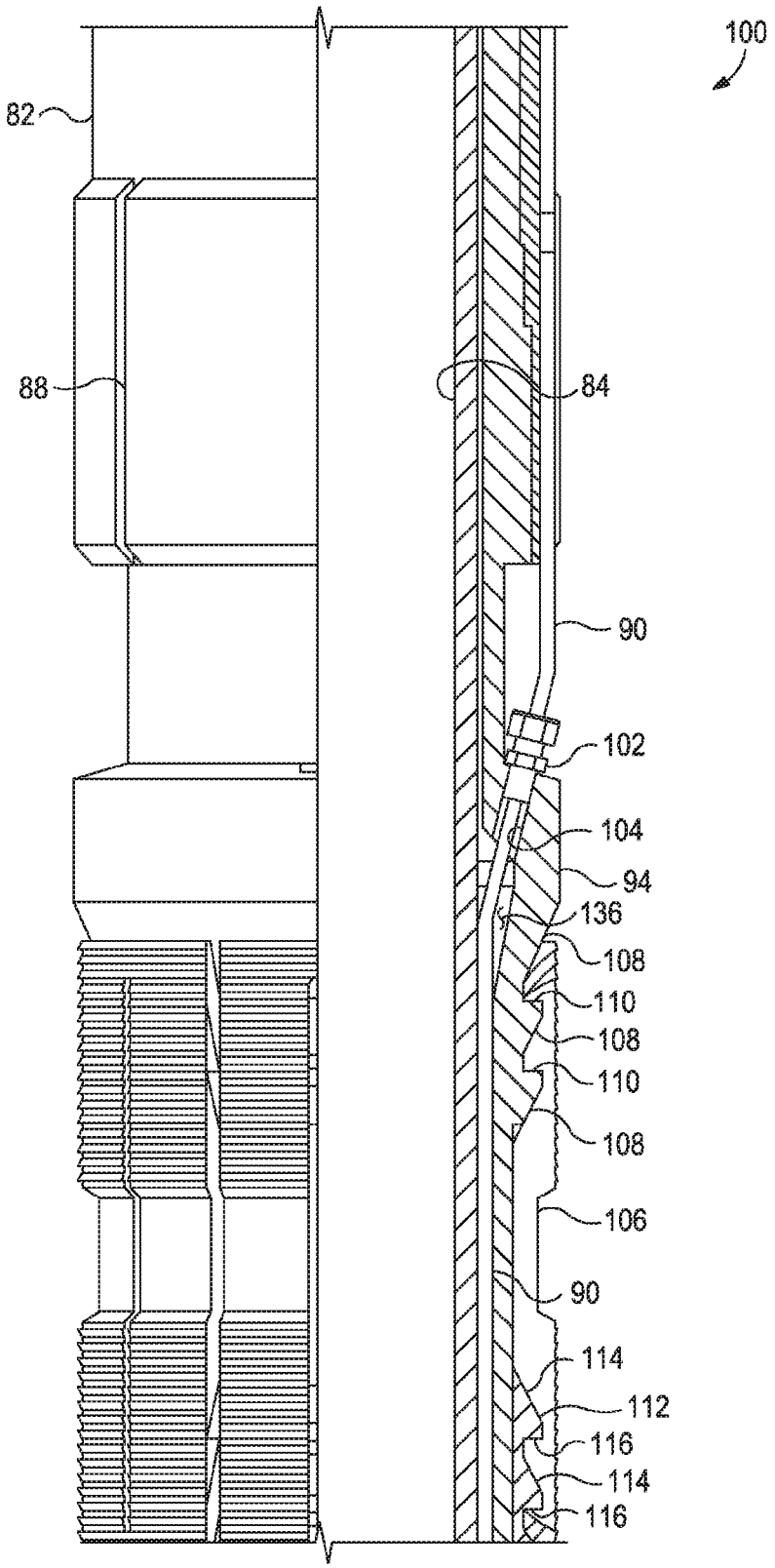

Referring now to FIG. 2C, the safety valve 100 includes an axially extending generally tubular upper housing 82, which has a polished inner diameter 84 formed therein. The upper housing 82 includes a series of axially extending slots 88 externally formed thereon. Contained in an axially aligned pair of the slots 88 is a setting line 90, which is similar to the control line 32 of the safety valve 100. However, the setting line 90 is used to conduct fluid pressure from the earth's surface to a piston 92 for setting the safety valve 100 (e.g., the packer elements such as the slips and sealing element package) in the wellbore. The setting line 90 is secured to the intermediate housing 94 by a conventional tube fitting 102. The setting line 90 extends from the exterior of the intermediate housing 94 to the interior of the intermediate housing through an opening 104 formed therethrough. From the opening 104, the setting line 90 extends axially downward, radially between the inner mandrel 78 and the intermediate housing 94. While described in terms of a setting line 90 conducting pressure from the earth's surface, other suitable fluid communication flowpaths may be used to provide pressure to and set the safety valve 100. In an embodiment, the setting line 90 may be in fluid communication with the central flowpath within the inner diameter 84, and a pressure within the central flowpath may be used to set the safety valve 100. In some embodiments, other suitable pressure sources (e.g., reservoirs, annulus pressure, etc.) may also be used.

Slips 106, of the type well known to those of ordinary skill in the art as "barrel" slips, are externally carried on the intermediate housing 94. The intermediate housing 94 has radially inclined axially opposing ramp surfaces 108, 110 externally formed thereon for alternately urging the slips 106 radially outward to grippingly engage the wellbore (e.g., casing 23) when the safety valve 100 is set therein, and retracting the slips radially inward when the safety valve 100 is conveyed axially within the wellbore. As shown in FIG. 2C, the faces 110 on the intermediate housing 94 are maintaining the slips 106 in their radially inwardly retracted positions. Note that other types of slips may be utilized on the safety valve 100 without departing from the principles of the present invention.

Figure 2D:
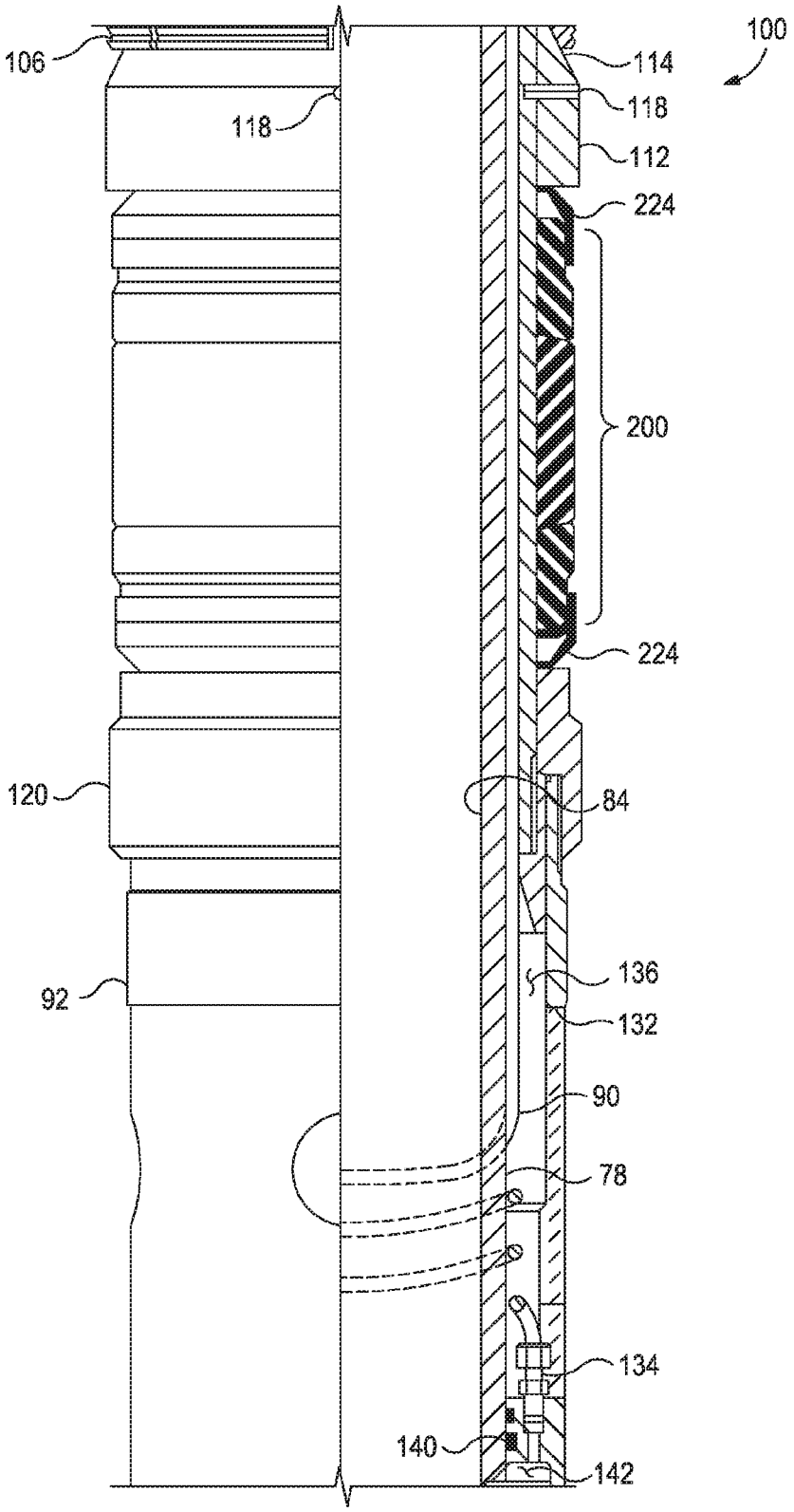

Referring now to FIGS. 2C and 2D, a generally tubular upper element retainer 112 is axially slidingly carried externally on the intermediate housing 94. The upper element retainer 112 has, similar to the intermediate housing 94, radially inclined and axially opposing ramp surfaces 114, 116 formed thereon. The upper element retainer 112 is releasably secured against axial displacement relative to the intermediate housing 94 by a series of four circumferentially spaced apart shear pins 118 installed radially through the upper element retainer and partially into the intermediate housing. A generally tubular lower element retainer 120 is axially slidingly disposed externally on the intermediate housing 94. The upper and lower element retainers 112, 120 axially straddle a sealing package comprising a plurality of sealing elements 200, with a conventional backup shoe 224 being disposed axially between the sealing elements 200 and each of the element retainers 112, 120. The plurality of sealing elements 200 is described in more detail below.

A window 132 formed radially through the piston 92 permits access to the setting line 90, and to a conventional tube fitting 134 which connects the setting line 90 to the piston 92. The setting line 90 is wrapped spirally about the inner mandrel 78, within the piston 92, so that, when the piston 92 displaces axially relative to the inner mandrel 78, the setting line 90 will be capable of flexing to compensate for the axial displacement without breaking. The window 132 also provides fluid communication between the exterior of the safety valve 100 below the sealing element package 200 and the interior 84 of the intermediate housing 94. Note that a flow passage 136 extends axially upward from the window 132, through the interior of the intermediate housing 94. The flow passage is in fluid communication with the ports 40 when the safety valve 100 is in its open configuration. If the safety valve 100 is in its closed configuration, such fluid communication is not permitted by sealing engagement of the sealing surfaces 42, 44.

Figure 2E:
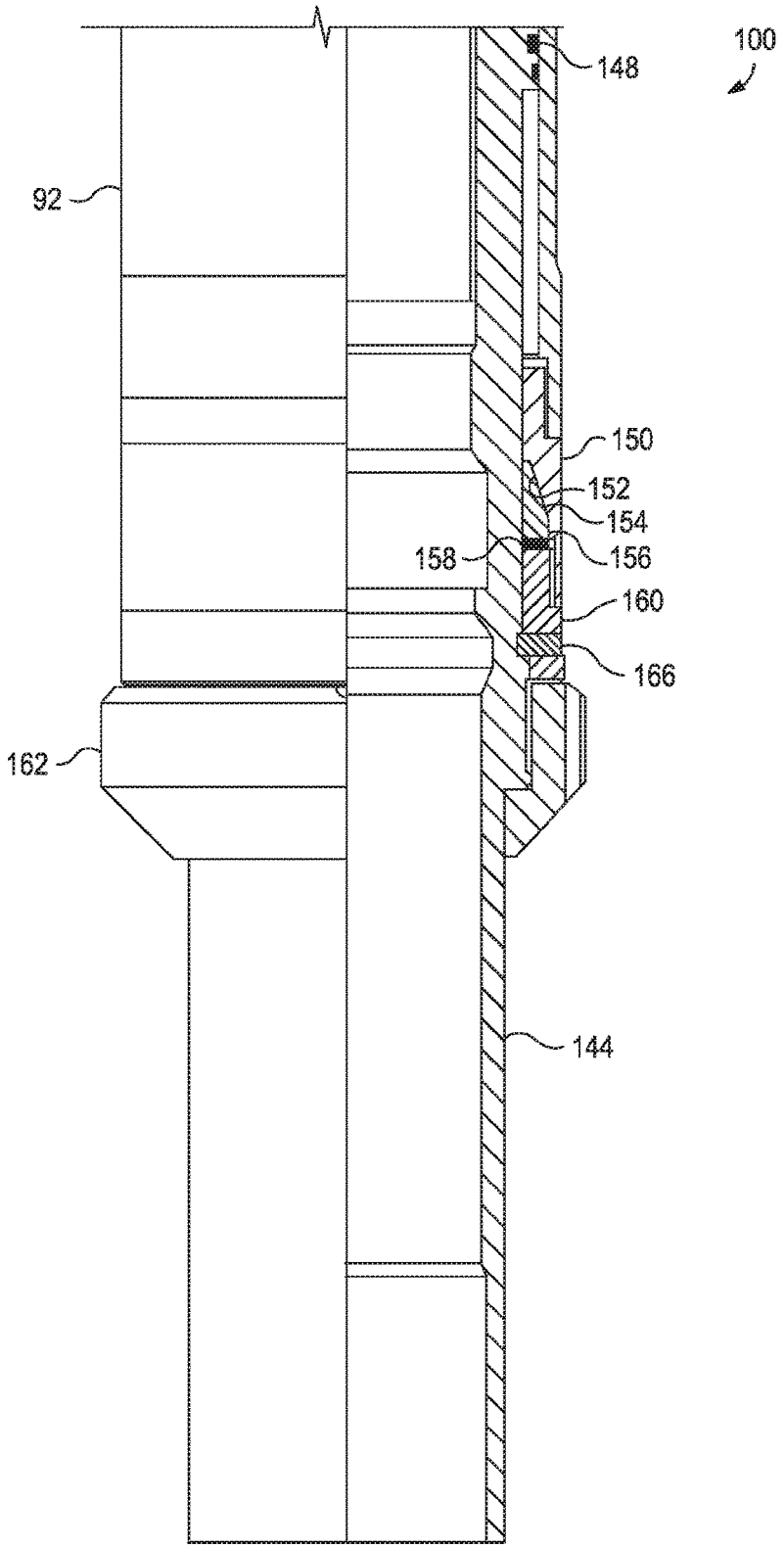

Referring now to FIGS. 2D and 2E, to set the safety valve 100 in the wellbore, fluid pressure is applied to the setting line 90 at the earth's surface. The fluid pressure is transmitted through the setting line 90 to the piston 92, which is axially slidingly disposed exteriorly on the inner mandrel 78. A circumferential seal 140 carried internally on the piston 92 sealingly engages the inner mandrel 78. The fluid pressure enters an annular chamber 142 formed radially between the piston 92 and the inner mandrel 78 and axially between the piston and a generally tubular and axially extending lower housing 144. The lower housing 144 carries a circumferential seal 148 externally thereon. The seal 148 sealingly engages an axially extending internal bore formed on the piston 92. Thus, when the fluid pressure enters the chamber 142, the piston 92 is thereby forced axially upward relative to the lower housing 144.

Referring now to FIG. 2E, a generally tubular slip housing 150 is threadedly attached to the piston 92. The slip housing 150 has an internal inclined surface 152 formed thereon, which complementarily engages an external inclined surface 154 formed on each of a series of circumferentially disposed internal slips 156 (only one of which is visible in FIG. 2E). The internal slips 156 are biased into contact with the slip housing 150 by a circumferentially wavy spring 158 disposed axially between the slips and a generally tubular slip retainer 160 threadedly attached to the slip housing 150. A collar 162 is threadedly attached to the lower housing 144 axially below the slip retainer 160 to thereby prevent the piston 92, slip housing 150, slip retainer, etc. from axially downwardly displacing relative to the lower housing.

Referring now to FIGS. 2D and 2E, when sufficient fluid pressure is applied in the chamber 142, a shear screw 166, which releasably secures the slip retainer 160 against axial displacement relative to the lower housing 144, is sheared, thereby permitting the slip retainer, slips 156, slip housing 150, piston 92, and lower element retainer 120 to displace axially upward relative to the lower housing and inner mandrel 78. The internal slips 156 are internally toothed so that they grippingly engage the lower housing 144. When an axially downwardly directed force is applied to the slip housing 150, the mating inclined surfaces 152, 154 bias the slips 156 radially inward to grip the lower housing 144 and prevent axially downward displacement of the slip housing 150 relative to the lower housing. On the other hand, when an axially upwardly directed force is applied to the slip housing 150, the spring 158 permits the slips 156 to axially displace somewhat downward relative to the slip housing, thereby permitting the slips 156 to radially outwardly disengage from the lower housing 144. Thus, the slip housing 150, slips 156, and slip retainer 160 may displace axially upward relative to the lower housing 144, but are not permitted to displace axially downward relative to the lower housing.

Referring now to FIG. 2D, as fluid pressure in the chamber 142 increases, the lower element retainer 120 pushes axially upward against the sealing element package 200 and backup shoes 224, which, in turn, push axially upward on the upper element retainer 112. When the fluid pressure is sufficiently great, the shear pins 118 shear and the lower element retainer 112 displaces axially upward relative to the intermediate housing 94. When the lower element retainer 112 displaces axially upward relative to the intermediate housing 94, the axial distance between inclined faces 108 and 114 decreases, thereby forcing the slips 106 radially outward to grippingly engage the wellbore (e.g., casing 23). Soon after the slips 106 grippingly engage the wellbore, the sealing element package 200 and backup shoes 224 are axially compressed between the upper and lower element retainers 112, 120, thereby extending the sealing elements radially outward to sealingly engage the wellbore (e.g. casing 23).

Referring now to FIGS. 2C-2E, when the slips 106 grippingly engage the wellbore, and the sealing element package 200 sealingly engage the wellbore, the safety valve 100 is "set" in the wellbore, and the annulus between the safety valve 100 and the wellbore (e.g., casing 23) is effectively divided into upper and lower portions (e.g., upper and lower annuli), with the sealing elements 200 preventing fluid communication thereacross. As noted above, the flow passage 136 may be used to provide fluid communication between the upper and lower annulus. The internal slips 156 prevent unsetting of the safety valve 100 by preventing axially downward displacement of the lower element retainer 120, piston 92, etc. relative to the lower housing 144. Thus, the fluid pressure does not have to be maintained on the setting line 90 to maintain the safety valve 100 set in the wellbore. Accordingly, fluid pressure in the setting line 90 may be released once the safety valve 100 is set.

When the safety valve 100 is open, the flow passage 136 extends from the ports 40 to the window 132, radially inwardly disposed relative to the sealing element package 200, so that when the sealing elements sealingly engage the wellbore, fluid communication may be achieved selectively between the upper and lower annulus. As described hereinabove, if fluid pressure in the control line 32 is released, or is otherwise insufficient to overcome the biasing force of the spring 46, the sealing surfaces 42, 44 will sealingly engage and close the flow passage 136.

Thus, it may be easily seen that, with the safety valve 100 set in the well, so that the sealing element package 200 sealingly engages the wellbore, the upper annulus between the safety valve 100 and the wellbore is in fluid communication with the lower annulus between the safety valve 100 below the sealing element package 200 and the wellbore when the safety valve 100 is open, and the upper annulus is not in fluid communication with the lower annulus when the safety valve 100 is closed. It may also be seen that the safety valve 100 fails closed, to thereby shut off fluid communication between the upper and lower annulus, when fluid pressure in the control line 32 is released.

Figure 3A:
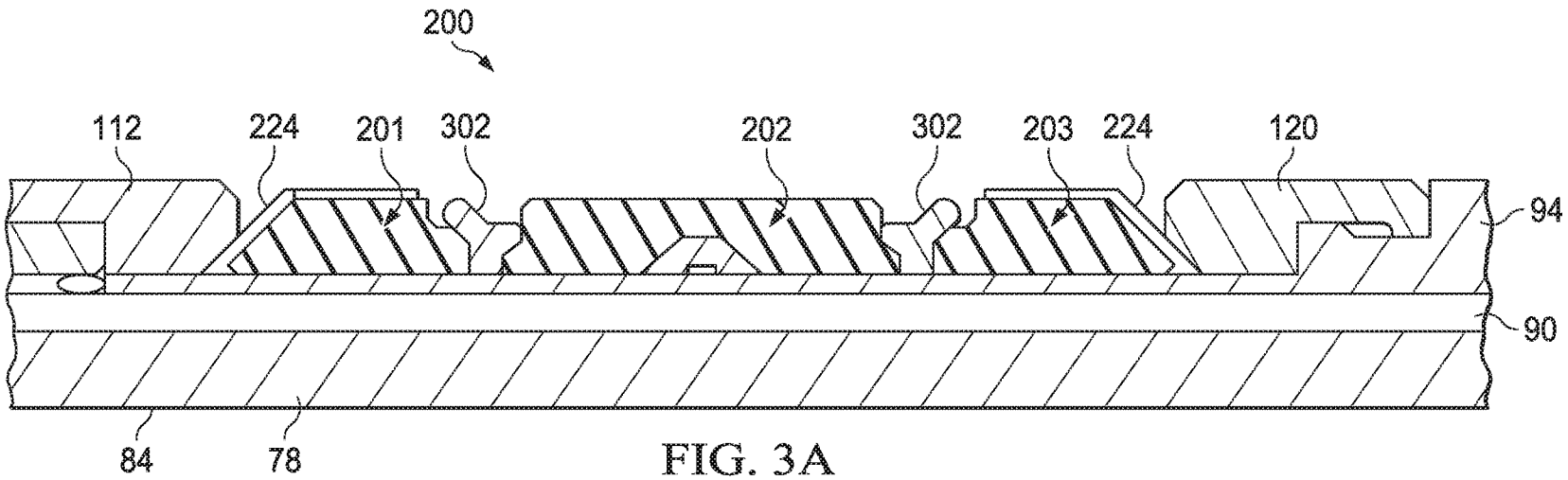
FIGS. 3A-3B are longitudinal cross-sectional views of a well bore safety valve having a sealing element according to an embodiment.
Figure 3B:
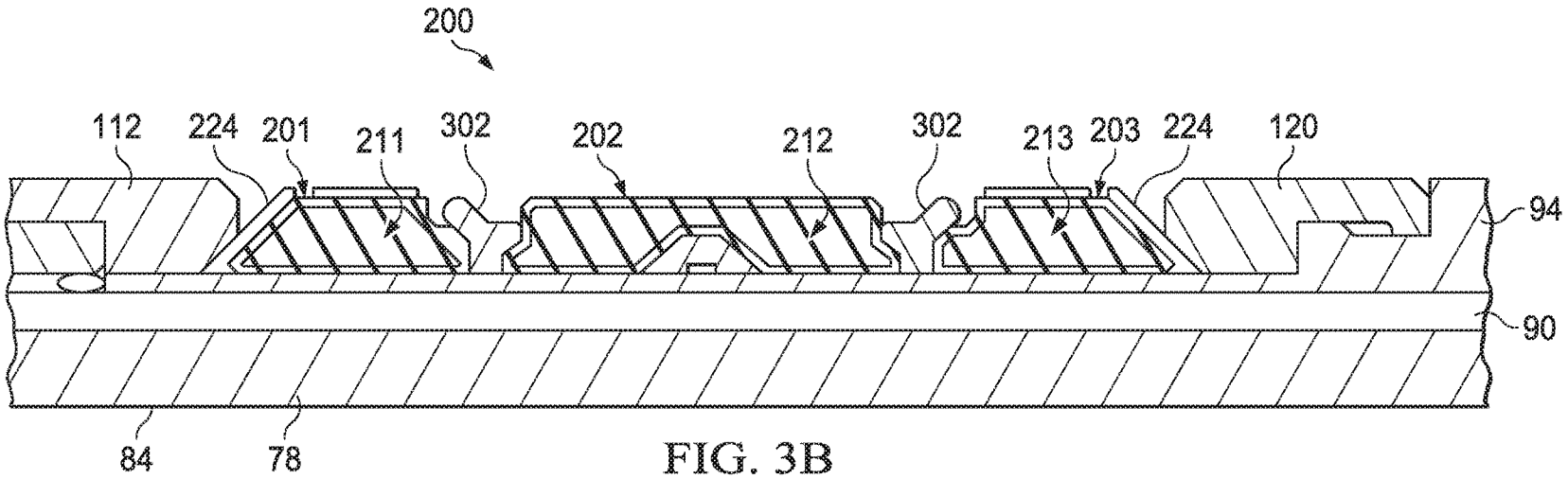

FIGS. 3A and 3B illustrate embodiments of the sealing package 200. Elements of the safety valve which are similar to those previously described of the safety valve 100 are indicated in FIGS. 3A-3B using the same reference numerals. In the embodiment of FIG. 3A, the sealing package 200 may generally comprise three sealing elements—two end sealing elements 201, 203 and one center sealing element 202. In an embodiment, one or more spacers 302 may be disposed between adjacent of the sealing elements 201, 202, 203. In an alternative embodiment, the sealing package 200 may comprise 4, 5, 6, or any other suitable number of sealing elements. Traditionally, all sealing elements have been made from the same material (e.g., HNBR, NBR, etc.). By constructing the sealing package 200 in a layered approach with at least two of the sealing elements comprising different materials, the layers can be tailored to suit the application in question. For the annular safety valve 100, the sealing elements may comprise one or more materials offering acid gas (e.g., $H_2S$) resistance and capable of maintaining seal performance at low temperatures. In some embodiments, the sealing elements may comprise one or more materials configured to withstand heat or, alternatively, steam.

In an embodiment, the sealing elements may comprise elastomeric compounds. Suitable elastomeric compounds may include, but are not limited to, nitrile butadiene rubber (NBR), hydrogenated nitrile butadiene rubber (HNBR), ethylene propylene diene monomer (EPDM), fluoroelastomers (FKM) [for example, commercially available as Viton®], perfluoroelastomers (FFKM) [for example, commercially available as Kalrez®, Chemraz®, and Zalak®], fluoropolymer elastomers [for example, commercially available as Viton®], polytetrafluoroethylene, copolymer of tetrafluoroethylene and propylene (FEPM) [for example, commercially available as Aflas®], and polyetheretherketone (PEEK), polyetherketone (PEK), polyamide-imide (PAI), polyimide [for example, commercially available as Vespel®], polyphenylene sulfide (PPS) [for example, commercially available as Ryton®], and any combination thereof. For example, instead of Aflas@, a fluoroelastomer, such as Viton® available from DuPont, may be used for the end sealing elements 201, 202. Not intending to be bound by theory, the use of a fluoroelastomer may allow for increased extrusion resistance and a greater resistance to acidic and/or basic fluids.

In the embodiment of FIG. 3A, end sealing elements 201, 203 may comprise HNBR and center sealing element 202 may comprise Aflas®. Aflas® is easily extruded, but does not recover from deformation easily; whereas HNBR generally recovers more easily from deformation. Further, Aflas® has a greater $H_2S$ resistance than that of HNBR while being a more expensive material than traditional HNBR. While not intending to be bound by theory, the use of Aflas® for only one sealing element, instead of all three, may reduce manufacturing costs while providing $H_2S$ resistance and extrusion resistance. In some embodiments, one or both of end sealing elements 201, 203 may comprise Aflas® and the center sealing element 202 may comprise HNBR. While not intending to be bound by theory, the use of Aflas® in one or both of the end sealing elements may provide more resistance to $H_2S$ and the HNBR in the center may provide some restoring force to the Aflas® end elements when released.

In some embodiments, each sealing element 201, 202, 203 may comprise a different elastomeric material. Alternatively, the top and center sealing elements 201, 202 may comprise an elastomer material with a greater chemical resistance than that of the bottom sealing element 203. Alternatively, the center and bottom sealing elements 202, 203 may comprise an elastomer material with a greater chemical resistance than that of the top sealing element 201. In an embodiment, a plurality of sealing elements may alternate between elastomer materials with greater and lesser chemical resistances for each contiguous annular sealing element.

FIG. 3B illustrates another embodiment of the sealing package 200. In the embodiment of FIG. 3B, the sealing package 200 may generally comprise three outer sealing element layers—two end sealing element layers 201, 203 and one center sealing element layer 202. The sealing package 200 further comprises three annular inner cores—two end sealing element cores 211, 213 and one center sealing element core 212. The annular inner cores 211, 212, 213 are disposed on the outer surface of the intermediate housing 94. In an embodiment, the annular inner cores 211, 212, 213 may be surrounded on three sides by, the annular outer layers 201, 202, 203, respectively. In some embodiments, the sealing package 200 may comprise 4, 5, 6, or any other suitable number of annular inner cores, and one or more outer layers, where the number of outer layers may correspond to the number of annular inner cores or may be less than the number of annular inner cores. While the sealing elements are described as comprising two layers (i.e., the outer sealing element layers and the annular inner cores), more than two layers may also be used. For example, 3, 4, 5, or more layers may be used to form one or more of the sealing elements. In an embodiment, a sealing element package may comprise one or more sealing elements having a layered configuration and one or more sealing elements comprising a single material throughout.

In an embodiment, the outer element layers 201, 203 of the outermost annular sealing elements may comprise an elastomeric material with a greater chemical resistance than the elastomeric material of the central annular sealing element outer element layer 202 and/or the elastomeric material of one or more of the annular inner cores 211, 212, 213. In an alternative embodiment, the outermost annular sealing outer element layers 201, 203 may comprise an elastomeric material with a greater chemical resistance than the elastomeric material of a plurality of central annular sealing outer element layers. In yet a further alternative embodiment, the chemical resistance of the elastomeric material of the annular sealing outer element layers may alternate between greater and lesser chemical resistances; thus, every other annular sealing outer element layer would have a greater chemical resistance followed by an annular sealing outer element layer with a lesser chemical resistance.

In an embodiment, the outer element layers 201, 202, 203 may comprise materials having greater chemical resistances than the material forming the annular inner cores 211, 212, 213. In this embodiment, the outer element layers may provide the chemical resistance to the compounds encountered within the wellbore while the annular inner cores may provide the mechanical properties useful in at least partially restoring the sealing elements when the annular safety valve is un-set.

In an embodiment, one or more outer layers 201, 202, 203 may comprise an FFKM, such as Chemraz® available from Green, Tweed and Co., and one or more inner cores 211, 212, 213 may comprise an HNBR or NBR. Not intending to be bound by theory, the FFKM may provide chemical resistance and the HNBR or NBR may provide increased resilience and strength. Nonlimiting examples of suitable elastomeric compounds for either outer layers 201, 202, 203, the inner cores 211, 212, 213, or both can include, but are not limited to, nitrile butadiene rubber (NBR), hydrogenated nitrile butadiene rubber (HNBR), ethylene propylene diene monomer (EPDM), fluoroelastomers (FKM) [for example, commercially available as Viton®], perfluoroelastomers (FFKM) [for example, commercially available as Kalrez®, Chemraz®, and Zalak®], fluoropolymer elastomers [for example, commercially available as Viton®], polytetrafluoroethylene, copolymer of tetrafluoroethylene and propylene (FEPM) [for example, commercially available as Aflas®], polyetheretherketone (PEEK), polyetherketone (PEK), polyamide-imide (PAI), polyimide [for example, commercially available as Vespel®], polyphenylene sulfide (PPS), and any combination thereof.

Returning to FIGS. 2A-2E, when the safety valve 100 is properly set, fluid pressure may be applied to the control line 32 to open the safety valve 100. With the safety valve 100 open, operations, such as gas lift operations, may be performed which require fluid communication between the upper and lower annulus (e.g., lift gas provided via the upper annulus and formation fluids such as oil provided via the lower annulus). If it is desired to close the safety valve 100, for example, if a fire or other emergency occurs at the earth's surface, the safety valve 100 may be closed by releasing the fluid pressure on the control line 32.

During normal operation, the safety valve 100 may be set within the annulus of a work string and configured in the open position. Fluid production (e.g., a gas, a hydrocarbon liquid, water, etc.) may then occur through the central wellbore tubular (e.g., wellbore tubular 19) and/or through the annulus 21 between the central wellbore tubular and the wellbore wall or casing 23. In some embodiments, a gas lift operation may be used to raise a liquid up the central wellbore tubular by introducing a gas into the central wellbore tubular. The gas may be supplied to the central wellbore tubular through the safety valve 100. In this embodiment, a method may comprise recovering a gas, which may be a sour gas comprising one or more acid gas or other components, reinjecting a portion of the recovered gas into the annulus 21 between the central wellbore tubular (e.g., wellbore tubular 19) and the wellbore wall or casing 23, and flowing the reinjected gas through safety valve and into the central wellbore tubular. In this embodiment, the gas passing through the safety valve may be in contact with at least a portion of the sealing element package. In some embodiments, the gas may be scrubbed between being produced and reinjected into the annulus. At a desired time, the annular safety valve may be closed and unset. The use of the sealing element package described herein may allow the sealing elements of the annular safety valve to at least partially recover or be restored to their initial configurations in an amount sufficient to allow the annular safety valve to be removed from the wellbore.

ADDITIONAL DISCLOSURE

The following are nonlimiting, specific embodiments in accordance with the present disclosure:

A first embodiment, which is an annular safety valve sealing package comprising:

an annular safety valve comprising a tubular housing;

a first annular sealing element comprising a first elastomeric material and disposed about the tubular housing of the annular safety valve;

a second annular sealing element comprising a second elastomeric material and disposed about the tubular housing of the annular safety valve adjacent the first annular sealing element; and a third annular sealing element comprising a third elastomeric material and disposed about the tubular housing of the annular safety valve adjacent the second annular sealing element and on an opposite side of the second annular sealing element from the first annular sealing element, wherein at least two of the first elastomeric material, the second elastomeric material, or the third elastomeric material have different compositions.

A second embodiment, which is the annular safety valve sealing package of the first embodiment, wherein the annular safety valve is configured to allow axial flow of a fluid through an annulus in a first configuration and substantially prevent axial flow of the fluid through the annular safety valve in a second configuration.

A third embodiment, which is the annular safety valve sealing package of the first embodiment or the second embodiment, wherein the first elastomeric material, the second elastomeric material, or the third elastomeric material comprises a material selected from the group consisting of: nitrile butadiene rubber, hydrogenated nitrile butadiene rubber, ethylene propylene diene monomer, fluoroelastomers, perfluoroelastomers, fluoropolymer elastomers, polytetrafluoroethylene, copolymer of tetrafluoroethylene and propylene, polyetheretherketone, polyetherketone, polyamide-imide, polyimide, polyphenylene sulfide, and any combination thereof.

A fourth embodiment, which is the annular safety valve sealing packages of any of the first embodiment to the third embodiment, wherein the first elastomeric material has a greater chemical resistance than the second elastomeric material.

A fifth embodiment, which is the annular safety valve sealing packages of any of the first embodiment to the third embodiment, wherein the second elastomeric material has a greater chemical resistance than the first elastomeric material.

A sixth embodiment, which is the annular safety valve sealing packages of any of the first embodiment to the fifth embodiment, where the first elastomeric material and the third elastomeric material are the same.

A seventh embodiment, which is the annular safety valve sealing packages of any of the first embodiment to the sixth embodiment, wherein the third elastomeric material has a greater chemical resistance than the second elastomeric material.

An eighth embodiment, which is the annular safety valve sealing packages of any of the first embodiment to the fifth embodiment or the seventh embodiment, wherein the first elastomeric material, the second elastomeric material, and the third elastomeric material each comprise different materials.

A ninth embodiment, which is an annular safety valve sealing package comprising:

an annular safety valve comprising a tubular housing; and a plurality of annular sealing elements disposed about the tubular housing, wherein one or more of the plurality of annular sealing elements comprise an annular inner core comprising a first elastomeric material and an outer element layer disposed on an outer surface of the annular inner core, wherein the outer element layer comprises a second elastomeric material.

A tenth embodiment, which is the annular safety valve sealing package of the ninth embodiment, wherein at least one of the first elastomeric material or the second elastomeric materials comprises a material selected from the group consisting of: nitrile butadiene rubber, hydrogenated nitrile butadiene rubber, ethylene propylene diene monomer, fluoroelastomers, perfluoroelastomers, fluoropolymer elastomers, polytetrafluoroethylene, copolymer of tetrafluoroethylene and propylene, polyetheretherketone, polyetherketone, polyamide-imide, polyimide, polyphenylene sulfide, and any combination thereof.

An eleventh embodiment, which is the annular safety valve sealing package of the ninth embodiment or the tenth embodiment, wherein the first elastomeric material has a greater chemical resistance than the second elastomeric material.

A twelfth embodiment, which is the annular safety valve sealing package of the ninth embodiment or the tenth embodiment, wherein the second elastomeric material has a greater chemical resistance than the first elastomeric material.

A thirteenth embodiment, which is the annular safety valve sealing packages of any of the ninth embodiment to the twelfth embodiment, wherein the first elastomeric material comprises hydrogenated nitrile butadiene rubber or nitrile butadiene rubber.

A fourteenth embodiment, which is the annular safety valve sealing packages of any of the ninth embodiment to the thirteenth embodiment, wherein the one or more of the plurality of annular sealing elements further comprise a third layer comprising a third elastomeric material disposed between the annular inner core and the outer element layer.

A fifteenth embodiment, which is the annular safety valve sealing packages of any of the ninth embodiment to the thirteenth embodiment, wherein each of the plurality of annular sealing elements comprise an annular inner core comprising the first elastomeric material and a corresponding outer element layer disposed on an outer surface of the corresponding annular inner core, wherein the outer element layer comprises the second elastomeric material.

A sixteenth embodiment, which is a method of providing gas lift in a wellbore comprising:

producing a gas from a production tubing located in a wellbore, wherein the wellbore comprises a casing disposed therein;

injecting a portion the gas into an annular space between the casing and the production tubing; and flowing the injected gas through an annular safety valve and into the production tubing;

wherein the annular safety valve comprises a tubular housing and a sealing package comprising a plurality of annular sealing elements disposed about the tubular housing;

wherein at least two of the plurality of annular sealing elements comprise elastomeric materials having different compositions.

A seventeenth embodiment, which is the method of the sixteenth embodiment, wherein one or more of the elastomeric materials comprises a material selected from the group consisting of: nitrile butadiene rubber, hydrogenated nitrile butadiene rubber, ethylene propylene diene monomer, fluoroelastomers, perfluoroelastomers, fluoropolymer elastomers, polytetrafluoroethylene, copolymer of tetrafluoroethylene and propylene, polyetheretherketone, polyetherketone, polyamide-imide, polyimide, polyphenylene sulfide, and any combination thereof.

An eighteenth embodiment, which is the method of the sixteenth embodiment or the seventeenth embodiment, wherein the gas comprises a sour gas.

A nineteenth embodiment, which is the method of the eighteenth embodiment, further comprising scrubbing the gas to remove a portion of contaminants prior to injection the portion of the gas.

A twentieth embodiment, which is the methods of any of the sixteenth embodiment to the nineteenth embodiment, further comprising removing the annular safety valve from the wellbore, wherein one or more of the plurality of annular sealing elements are at least partially restored to their initial positions.

A twenty-first embodiment, which is the method of the twentieth embodiment, wherein the annular safety valve is removed after exposure to sour gas while in the wellbore.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. An annular safety valve sealing package comprising:

an annular safety valve comprising a tubular housing, wherein the annular safety valve is configured to allow axial flow of a fluid through an annulus in a first configuration and substantially prevent axial flow of the fluid through the annular safety valve in a second configuration; and a plurality of annular sealing elements disposed about the tubular housing, wherein one or more of the plurality of annular sealing elements comprise:

an annular inner core disposed around the tubular housing and comprising a first elastomeric material; and an outer element layer covering at least a radially outward facing surface of the annular inner core, wherein the outer element layer comprises a second elastomeric material having a composition different from the first elastomeric material, wherein the outer element layer is disposed on at least three sides of the annular inner core including the radially outward facing surface of the annular inner core.

2. The annular safety valve sealing package of claim 1, wherein at least one of the first elastomeric material or the second elastomeric materials comprises a material selected from the group consisting of: nitrile butadiene rubber, hydrogenated nitrile butadiene rubber, ethylene propylene diene monomer, fluoroelastomers, perfluoroelastomers, fluoropolymer elastomers, polytetrafluoroethylene, copolymer of tetrafluoroethylene and propylene, polyetheretherketone, polyetherketone, polyamide-imide, polyimide, polyphenylene sulfide, and any combination thereof.

3. The annular safety valve sealing package of claim 1, wherein the second elastomeric material has a greater chemical resistance than the first elastomeric material.

4. The annular safety valve sealing package of claim 1, wherein the one or more of the plurality of annular sealing elements further comprise a third layer comprising a third elastomeric material disposed between the annular inner core and the outer element layer.

5. The annular safety valve sealing package of claim 1, wherein each of the plurality of annular sealing elements comprise:

an annular inner core comprising the first elastomeric material disposed around the tubular housing; and a corresponding outer element layer covering at least a radially outward facing surface of the corresponding annular inner core, wherein the outer element layer comprises the second elastomeric material.

6. The annular safety valve sealing package of claim 1, wherein the first elastomeric material has a greater level of mechanical resilience than the first elastomeric material, and wherein the second elastomeric material is chemically resistant to acidic fluids.

7. The annular safety valve sealing package of claim 1, wherein the first elastomeric material has a greater chemical resistance than the second elastomeric material.

8. The annular safety valve sealing package of claim 1, wherein the first elastomeric material comprises hydrogenated nitrile butadiene rubber or nitrile butadiene rubber.

* * * * *